United States Patent [19]

Pacanski

[11] Patent Number: 4,984,792

[45] Date of Patent: Jan. 15, 1991

[54] WEIGHTED TENNIS/RACQUETBALL RACKET

[76] Inventor: Jan Pacanski, 38 Goodwin St., Bristol, Conn. 06010

[21] Appl. No.: 60,485

[22] Filed: Jun. 11, 1987

[51] Int. Cl.[5] ..... A63B 49/02

[52] U.S. Cl. ..... 273/73 C

[58] Field of Search ..... 273/73 C, 73 R, 73 S, 273/75, 73 H

[56] References Cited

U.S. PATENT DOCUMENTS

| | | | |
|---|---|---|---|
| 2,274,788 | 3/1942 | Hatton | 273/73 K |
| 4,182,512 | 1/1980 | Kuebler | 273/73 C |
| 4,330,125 | 5/1982 | Sassler | 273/73 C |

FOREIGN PATENT DOCUMENTS

| | | | |
|---|---|---|---|
| 407983 | 3/1934 | United Kingdom | 273/75 |

*Primary Examiner*—Edward M. Coven
*Assistant Examiner*—William E. Stoll
*Attorney, Agent, or Firm*—Richard C. Litman

[57] ABSTRACT

An improvement in the rackets used in tennis and racquetball a round conduit in the frame or head of the racket, which is divided into two chambers by valve elements. A lower chamber containing mercury or other liquid communicates, through the valve elements, to an upper chamber. In use, the liquid is directed, by gravity and centrifugal force, between the two chambers to increase the amount of kinetic energy exerted against a ball, providing for a more powerful swing and improved tennis or racquetball game.

2 Claims, 2 Drawing Sheets

WEIGHTED TENNIS/RACQUETBALL RACKET

BACKGROUND OF THE INVENTION

1. Field of the Invention

This invention is directed towards a weighted tennis or racquetball racket that has a liquid mass which is released via centrifugal forces from a chamber and allowed to flow freely within the head of the racket. It is designed for use by both the professional and nonprofessional and reduces the risk of what is commonly referred to in the tennis or racquetball world as "tennis elbow". The amount of weight released depends strictly on how strong or fast the racket is swung. Because of the concentrated weight in the head of the racket, the ball is bounced harder off of the net, providing a stronger and more direct return.

2. Description of the Prior Art

Various prior art weighted rackets and the like, as well as the apparatus and method of their construction in general, are known and found to be exemplary of the U.S. prior art. They are:

| Patent | Inventor |
|---|---|
| Australia No. 15,733 | Paul |
| British No. 407,983 | Bush |
| W. Germany No. 2741741 | Kuebler & Co. |

U.S. Pat. No. 15,733 comprises a channel or passage provided longitudinally and centrally in the handle of the racket in which said passage houses a slidable weight. However, it does not provide for weights in the head of the racket nor does it provide a weight dispenser as does the present invention. U.S. Pat. No. 407,983, like the previous patent, comprises a groove or channel in the handle of the racket for the flow of a liquid mass. U.S. Pat. No. 2,741,741 discloses a tennis racket with a frame that is formed by one or two hollow sections. These sections are divided into a number of individual chambers which are partially or completely filled with granulated weights. Although in this prior patent the weights are in the head of the racket, it differs from the embodiment of the present invention in that it always has weights inside the chambers, it has limited ability to position the weights in the places needed most, it increases the overall weight of the racket, and it contains a number of separate chambers filled partially or completely with granulated weights which allow for a rattling effect while playing.

These patents or known prior uses teach and disclose various types of weighted rackets of sorts and of various manufactures. However, none of them, whether taken singly or in combination, discloses the specific details of the combination of this invention in such a way as to bear upon the claims of the present invention.

SUMMARY OF THE INVENTION

It is the object of the invention to provide a novel mechanism which is free from the limitations of the prior art and lends itself to the application of weighted tennis or racquetball rackets. It is specially designed to provide means for enhancing the driving effect of the player's stroke by concentrating a liquid mass within the head of the racket by use of centrifugal forces. This method will allow the weight to be allocated where it is needed most.

Another object of the invention is to provide an improved construction over the prior art, whereby the invention would not inhibit its user.

These, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE PREFERRED EMBODIMENT

Figures 1, 2:
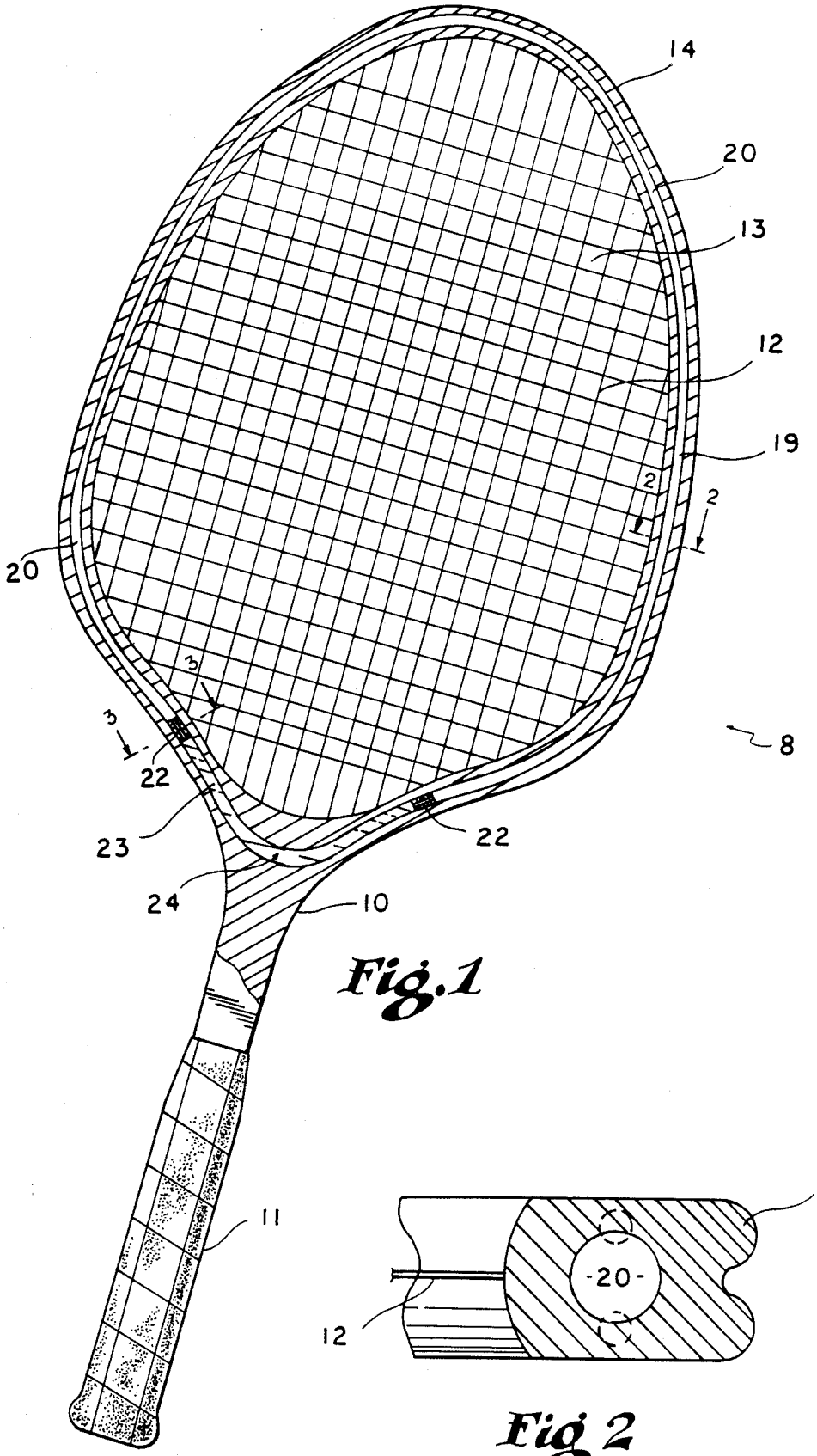
FIG. 1 is a plan view, partly in section, illustrating typical components of a tennis or racquetball racket according to a preferred embodiment and best mode of the invention.
FIG. 2 is a sectional view of the racket taken along lines 2—2 of FIG. 1.

FIG. 1 illustrates, partly in section, a typical racket 8 having a frame 14 provided with a base 10 joined to a handle 11. The frame is strung with a net 12 spanning the open area 13 defined by the frame.

Figure 3:
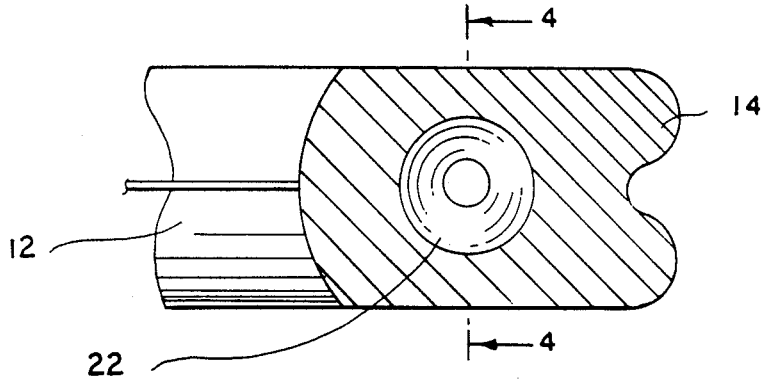
FIG. 3 is a sectional view of the racket taken along lines 3—3 of FIG. 1.
Figure 4:
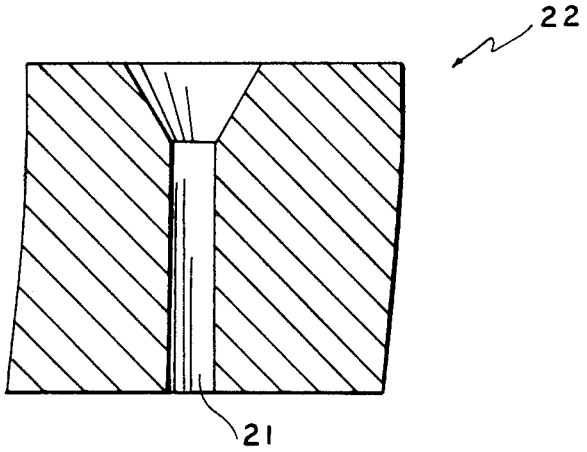
FIG. 4 is a sectional view of FIG. 3 taken along lines 4—4 thereof.

The frame 14, shown in FIGS. 1 and 2, has a round conduit 20 within the racket head 10 and frame 14. At the base of the racket head 10 and within the round conduit 20 is a lower chamber 23 which contains mercury 24 or any other liquid which is very dense. The lower chamber 23 is sectioned off from an upper chamber 19 of the round conduit 20 by two valves 22, shown in FIGS. 1, 3, and 4, providing a restricted bore 21 that allows the mercury 24 to flow initially from the lower chamber 23 into the round conduit 20 and subsequently, using the forces of gravity, from the conduit 20 back into the lower chamber 23.

The amount of weight introduced to the racket head 10 is proportional to the amount of mercury 24 that is released from the lower chamber 23. The amount of mercury 24 released from the lower chamber 23 depends strictly on how strong or fast the stimulated from the swinging of the racket 8, directs the mercury 24 from the lower chamber 23 into the round conduit 20 via each of the valves 22. Depending on the movement of the racket 8 and its orientation upon striking the ball, centrifugal forces position the mercury 24 at a point within the round conduit 20 where it is needed most. This increases the amount of kinetic energy that is exerted against the ball, not shown, and provides for a more powerful swing for the racket 8 and reduces bouncing of the racket 8, which is said to tend to cause "tennis elbow".

What is claimed is:

1. In a weighted racket for tennis or racketball provided with a frame having a base joined to a handle and including a net spanning an open area defined by the frame, the improvement comprising;

an endless continuous conduit disposed fully within said frame and frame base and encircling said open area, fluid restricting means within said conduit symmetrically disposed relative to a longitudinal axis extending through said handle and adapted to regulate the flow of liquid from one side of said fluid restricting means to the other side, said fluid restricting means comprising a pair of spaced apart valve elements each having a reduced diameter bore disposed within said conduit and defining upper and lower chambers within said conduit respectively within said frame and base with said upper and lower chambers on opposite sides of said valve elements, and a liquid partially filling said conduit whereby, swinging of said racket produces a restricted displacement of said liquid between said chambers in said base and frame as said liquid passes through said valve elements.

2. A racket according to claim 1 wherein, said liquid is mercury.

* * * * *